United States Patent [19]

Newmiller

[11] Patent Number: 4,865,964

[45] Date of Patent: Sep. 12, 1989

[54] BLENDED EMULSIONS EXHIBITING IMPROVED SPEED-GRANULARITY RELATIONSHIP

[75] Inventor: Robert J. Newmiller, Rochester, N.Y.

[73] Assignee: Eastman Kodak Company, Rochester, N.Y.

[21] Appl. No.: 172,925

[22] Filed: Mar. 25, 1988

[51] Int. Cl.[4] ..... G03C 1/04; G03C 1/46; G03C 7/26

[52] U.S. Cl. ..... 430/367; 430/569; 430/506; 430/509; 430/571

[58] Field of Search ..... 430/567, 569, 506, 509, 430/571

[56] References Cited

U.S. PATENT DOCUMENTS

| | | | |
|---|---|---|---|
| 3,140,179 | 7/1964 | Russell | 430/506 |
| 3,152,907 | 10/1964 | Gudowsky et al. | 430/545 |
| 4,439,520 | 3/1984 | Kofron et al. | 430/434 |
| 4,585,729 | 4/1986 | Sugimoto et al. | 430/509 |
| 4,640,889 | 2/1987 | Komorita et al. | 430/567 |
| 4,686,176 | 8/1987 | Yagi et al. | 430/506 |

*Primary Examiner*—Paul R. Michl
*Assistant Examiner*—Patrick A. Doody
*Attorney, Agent, or Firm*—Carl O. Thomas

[57] ABSTRACT

Siliver halide photographic elements are disclosed comprised of blended emulsions. An improved relationship between speed and granularity can be realized when a blended silver bromide or bromoiodide emulsion is comprised of a high aspect ratio tabular grain emulsion containing at least one spectral sensitizing dye and a low aspect ratio grain emulsion.

12 Claims, No Drawings

BLENDED EMULSIONS EXHIBITING IMPROVED SPEED-GRANULARITY RELATIONSHIP

FIELD OF THE INVENTION

This invention relates to photography, specifically to radiation-sensitive silver halide emulsions employed for image recording on photographic elements.

BACKGROUND OF THE INVENTION

When radiation-sensitive silver halide emulsions differing in mean grain size are optimally sensitized, there is a predictable relationship between photographic speed and granularity. It is generally recognized that each doubling of photographic speed results in an increase of 5–7 granularity units. When emulsions of differing speed also differ in granularity by a predicted number of granularity units, the emulsions are said to exhibit the same speed-granularity relationship. An emulsion which shows increased speed without a proportional increase in granularity units is not only a faster emulsion, but an emulsion exhibiting a superior speed-granularity relationship. An emulsion which exhibits reduced granularity without a proportionate loss of speed also exhibits an improved speed-granularity relationship.

Kofron et al U.S. Pat. No. 4,439,520 teaches that substantially optimally sensitized high aspect ratio tabular grain emulsions are capable of exhibiting improved speed-granularity relationships and other significant photographic advantages. Kofron et al in column 41, line 42, through column 42, line 21, discloses employing high aspect ratio tabular grain emulsions in combination with conventional emulsions, either by blending the emulsions or by coating the emulsions in separate layers. Kofron et al recognizes that when a fine grain silver chloride emulsion is blended with a high aspect ratio tabular grain emulsion an improvement in the speed-granularity relationship of the blended emulsion can be realized. In general, however, Kofron et al teaches that increased photographic speed occurs when faster and slower silver halide emulsions are coated in separate layers as opposed to blending.

Silver bromide and silver bromoiodide emulsions are almost invariably selected for photographic and radiographic applications requiring the highest levels of photographic speed. Notwithstanding the advances in the art which Kofron et al represents, there has remained a need for silver bromide and bromoiodide emulsions with still better speed-granularity relationships.

SUMMARY OF THE INVENTION

The present invention is based on the discovery that unexpected improvements in the speed-granularity relationships of silver bromide and bromoiodide emulsions can be realized when spectrally sensitized high aspect ratio tabular grain silver bromide or bromoiodide emulsions are blended with low aspect ratio grain silver bromide or bromoiodide emulsions, provided the proportions, based on silver, and the speed relationships of the two silver bromide or bromoiodide emulsions to be blended fall within certain selection limits.

In one form the present invention is directed to a blended emulsion comprised of (i) 10 to 90 percent, based on total silver, of a high aspect ratio tabular grain emulsion containing at least one spectral sensitizing dye and (ii) 90 to 10 percent, based on total silver, of a low aspect ratio grain emulsion, said high and low aspect ratio grain emulsions being silver bromide or bromoiodide emulsions and exhibiting, prior to blending, relative speeds which differ by less than 50 percent, based on the higher speed emulsion.

DESCRIPTION OF PREFERRED EMBODIMENTS

The emulsions of the present invention are silver bromide or bromoiodide emulsions comprised of a blend of two component emulsions, one a high aspect ratio tabular grain emulsion containing a spectral sensitizing dye and the other a low aspect ratio grain emulsion.

To realize a speed-granularity advantage it is essential that the two component emulsions be selected so that they are relatively closely matched in their photographic speeds. Specifically, the high and low aspect ratio grain emulsions must exhibit, prior to blending, relative speeds which differ by less than 50 percent, based on the speed of the higher speed component emulsion. It is generally preferred that the two component emulsions, prior to blending, have relative photographic speeds which differ by less than 30 percent and, optimally, less than 10 percent, based on the speed of the higher speed component emulsion. Relative speeds are compared at the wavelength of peak absorption within the visible portion of the spectrum of the spectral sensitizing dye in the high aspect ratio tabular grain emulsion.

The proportions of the two component emulsions in the blended emulsion can vary widely while still realizing the improved speed-granularity relationship afforded by this invention. The blended emulsion can be comprised of from 10 to 90 percent, based on total silver, of a spectrally sensitized high aspect ratio tabular grain emulsion and from 90 to 10 percent, based on total silver, of a low aspect ratio grain emulsion. It is generally preferred that the blended emulsion contain from 25 to 75 percent, based on total silver, of a spectrally sensitized high aspect ratio tabular grain emulsion and from 75 to 25 percent, based on total silver, of a low aspect ratio grain emulsion. Optimum speed-granularity advantages generally occur when one of the two component emulsions forms at least 40 percent, based on total silver, of the blended emulsion, with the remaining component emulsion forming the balance of the blended emulsion.

As employed herein the term "high aspect ratio tabular grain emulsion" refers to an emulsion in which tabular grains are present which have an average aspect ratio of greater than 8:1 and account for at least 50 percent of the total projected area of the emulsion. Aspect ratio is herein defined as the ratio of the equivalent circular diameter of a grain based on its projected area to its thickness. High aspect ratio tabular grain silver bromide and bromoiodide emulsions satisfying this definition are disclosed in Wilgus et al U.S. Pat. No. 4,434,226; Kofron et al U.S. Pat. No. 4,439,520; Daubendiek et al U.S. Pat. No. 4,414,310; Abbott et al U.S. Pat. No. 4,425,425; Solberg et al U.S. Pat. No. 4,433,048; Jones et al U.S. Pat. No. 4,478,929; Maskasky U.S. Pat. Nos. 4,435,501, 4,643,966; and 4,684,607; Sowinski et al U.S. Pat. No. 4,656,122; Dickerson U.S. Pat. No. 4,520,098; and Daubendiek et al U.S. Pat. Nos. 4,672,027 and 4,693,964, the disclosures of which are here incorporated by reference.

High aspect ratio tabular grain silver bromide and silver bromoiodide emulsions preferred for use in the practice of this invention are those in which the tabular grains are relatively thin. Preferred silver bromide and silver bromoiodide high aspect ratio tabular grain emulsions those in which tabular grains having a thickness of less than 0.3 μm (optimally less than 0.2 μm) account for 50 percent of the total grain projected area. In the preferred high aspect ratio tabular grain emulsions the average aspect ratio is at least 12:1 and optimally at least 20:1. Average aspect ratios can range up to 200:1 or even higher, but typically range up to about 100:1. Further, the tabular grains preferably account for at least 70 percent and optimally at least 90 percent of the total grain projected area of the high aspect ratio tabular grain emulsion. Thus, in specifically preferred forms of the invention the high aspect ratio tabular grain emulsions are those in which tabular grains having a thickness of less than 0.3 μm (optimally less than 0.2 μm) have an average aspect ratio of at least 12:1 (optimally at least 20:1) and account for at least 70 percent (optimally at least 90 percent) of the total grain projected area.

The emulsions of the invention contain a high aspect ratio tabular grain silver bromide or silver bromoiodide emulsion blended with a low aspect ratio grain silver bromide or bromoiodide emulsion. As employed herein the term "low aspect ratio grain emulsion" is defined as an emulsion in which greater than 50 percent (preferably greater than 70 percent and optimally greater than 90 percent) of the total grain projected area is accounted for grains which have an aspect ratio of less than 3:1. The grains can take any regular or irregular shape compatible with a low aspect ratio configuration. For example, the grains can be regular octahedra, cubes, or any of the other regular grain shapes disclosed in Maskasky U.S. Pat. No. 4,643,966. The grains can be irregular in shape. For example, the grains can be singly, doubly, or multiply twinned. All or a portion of the grains can be tabular grains, provided the aspect ratio requirements set forth above are satisfied. The grains can be relatively similar in shape or can differ widely in shape. The grains can be similar in size, forming a monodisperse emulsion, or can vary widely in size, forming a polydisperse emulsion. For example, monodisperse low aspect ratio grain silver bromide or silver bromoiodide emulsions of similar grain morphologies and narrow size-frequency distributions can be readily prepared by conventional double-jet precipitation techniques. On the other hand, conventional single-jet precipitation techniques are known to form polydisperse low aspect ratio grain emulsions differing widely in shape and size. Exemplary single-jet and double-jet procedures for preparing low aspect ratio grain emulsions satisfying the requirements of this invention are disclosed in *Research Disclosure,* Vol. 176, December 1978, Item 17643, Section I, here incorporated by reference. *Research Disclosure* is published by Kenneth Mason Publications, Ltd., Emsworth, Hampshire P010 7DD, England.

The blended component emulsions can be silver bromide emulsions. In other words, they need not contain any iodide. However, generally more favorable speed-granularity relationships are realized when the blended component emulsions are silver bromoiodide emulsions. In such instance, the iodide content of the blended component emulsions described above can be at any level found in conventional silver bromoiodide emulsions. Iodide contents as low as 0.1 mole percent, based on silver, and as high as 40 mole percent, based on silver, the saturation limit of iodide in silver bromide, are possible. In most instances iodide contents ranging from 0.5 to 20 mole percent, based on silver, are contemplated, with iodide contents of from about 1 to 12 mole percent, based on silver being optimum for most photographic applications.

In a preferred form the blended component emulsions described are each surface latent image forming negative-working emulsions. The emulsions can, if desired, contain dopants to modify their photographic properties, such as speed, high or low intensity reciprocity characteristics, stability, and contrast. Conventional grain modifiers are illustrated by those described in *Research Disclosure,* Item 17643, Section I, cited above, and here incorporated by reference. If desired, one or, preferably, both of the blended component emulsions can be doped to form an internal latent image. Internal latent image emulsions can be employed in either direct-positive or negative imaging. Gilman et al U.S. Pat. No. 3,979,213, for example, teaches using negative-working internal latent image emulsions to avoid dye desensitization at higher spectral sensitizing dye coverages. Preferred internal latent image forming high aspect ratio tabular grain emulsions employed as components for blending are disclosed by Evans et al U.S. Pat. No. 4,504,570. Preferred internal latent image forming low aspect ratio grain emulsions are those disclosed by Evans U.S. Pat. No. 3,761,276.

To achieve their highest speed-granularity relationships the component emulsions are each surface chemically sensitized. Noble metal (e.g., gold), middle chalcogen (e.g., sulfur or selenium), and reduction surface chemical sensitization, singly and in combination, are contemplated. Such surface chemical sensitizations are illustrated by *Research Disclosure,* Item 17643, cited above, Section II. Specifically preferred surface chemical sensitizations of high aspect ratio tabular grain component emulsions are taught by Kofron et al U.S. Pat. No. 4,439,520.

The high aspect ratio tabular grain component emulsions are in each instance spectrally sensitized by the inclusion of at least one spectral sensitizing dye. Additive and supersensitizing combinations of spectral sensitizing dyes are specifically contemplated. Sufficient spectral sensitizing dye is adsorbed to the grains of the high aspect ratio tabular grain component emulsion to achieve substantially optimum spectral sensitization. That is, sufficient spectral sensitizing dye is present in the emulsion to raise its speed to within about 60 percent of the maximum attainable speed of the emulsion at the peak wavelength of light absorption by the dye. Generally, optimum spectral sensitizing dye coverage is that which corresponds to a monolayer dye coverage of from about 25 to 100 percent of the total surface area provided by the grains. Any conventional spectral sensitizing dye or combination of conventional spectral sensitizing dyes can be adsorbed to the grain surfaces. For color imaging generally one or a combination of spectral sensitizing dyes are chosen which exhibit peak absorption in one of the blue, green, or red portions of the spectrum. For black-and-white imaging both orthochromatic and panchromatic spectral sensitizations are contemplated. Conventional spectral sensitizing dyes and procedures for their use are disclosed by *Research Disclosure,* Item 17643, cited above, Section III, and Kofron et al U.S. Pat. No. 4,439,520, the latter containing an expanded description of useful blue spectral sensitizing dyes.

The low aspect ratio grain component emulsions can be spectrally sensitized similarly as described above for the high aspect ratio tabular grain component emulsions. However, for the low aspect ratio grain emulsions spectral sensitization is not in all instances required. For example, when the high aspect ratio tabular grain component emulsion is sensitized with a spectral sensitizing dye having its peak absorption in the blue portion of the spectrum, the low aspect ratio grain emulsion will often exhibit sufficiently matched blue speeds (i.e., relative blue speeds of the two component emulsions differing by less than 50 percent, based on the relative speed of the higher speed emulsion) without the incorporation of a blue spectral sensitizing dye. This is particularly true when the low aspect ratio grain emulsion is a silver bromoiodide emulsion, since the presence of iodide significantly increases the native sensitivity of the grains to blue light. Native sensitivity to blue light increases with increasing iodide levels. Thus, for the preferred higher iodide levels noted above, low aspect ratio grain component emulsions exhibit relatively smaller increases in blue speed than high aspect ratio tabular grain component emulsions when a blue sensitizing dye is incorporated.

Each of the component emulsions contain a conventional vehicle, such as a hydrophilic colloid (e.g., gelatin or modified gelatin), and, optionally, a vehicle extender. The blended emulsions of the invention additionally contain one or more conventional hardeners, the hardeners preferably being added after blending the component emulsions. Referring to *Research Disclosure* Item 17643, conventional vehicles and vehicle extenders are illustrated by Section IX while conventional hardeners are illustrated by Section X.

In addition to chemical and spectral sensitizers the blended emulsions of the invention can contain any of a wide variety of conventional addenda. For example, again referring to *Research Disclosure* Item 17643, the emulsions can contain optical brighteners, as illustrated by Section V; antifoggants and stabilizers, as illustrated by Section VI; color materials (e.g., dyes, dye-forming couplers, and dye image modifying couplers), as illustrated by Section VII; light absorbing or scattering materials, as illustrated by Section VIII; coating aids, as illustrated by Section XI; plasticizers and lubricants, as illustrated by Section XII; developing agents, as illustrated by Section XX; and/or development modifiers, as illustrated by Section XXI.

The blended emulsions can be substituted for one or more conventional silver bromide or silver bromoiodide emulsion layers in conventional photographic elements. For example, the blended silver bromide and silver bromoiodide emulsions of the present invention can be substituted for conventional silver bromide and silver bromoiodide high aspect ratio tabular grain emulsions in known photographic and radiographic elements. Such photographic and radiographic elements are illustrated in the patents cited above to show conventional silver bromide and silver bromoiodide high aspect ratio tabular grain emulsions. Again referring to *Research Disclosure* Item 17643, cited above, suitable supports for such photographic elements are illustrated by those disclosed in Section XVII. The elements can contain in the emulsion layers or in separate overcoat protective layers matting agents, as illustrated in Section XVI. The elements can contain antistatic layers, as illustrated in Section XIII. The same vehicles and vehicle extenders noted above for completing the emulsions of the invention can be employed to form overcoat and interlayers for the elements. The elements can be formed by the coating and drying procedures illustrated by Section XV. Exposure of the photographic and radiographic elements containing the blended emulsions of the invention are illustrated by Section XVII. Processing of these elements is illustrated by Section XIX.

EXAMPLES

The invention and its advantages can be better appreciated by reference to the following specific examples.

Example 1 Coatings of Emulsions of Equal Speed

Example 1A Low Aspect Ratio Grain Emulsion

Example 1A was a silver bromoiodide low aspect ratio (<3:1) grain emulsion, 9 mole percent iodide, of mean grain size 0.97 μm. The emulsion was optimally sulfur and gold sensitized, and spectrally sensitized with 194 mg/Ag mole of Dye I, anhydro-5,5'-dimethoxy-3,3'-bis(3-sulfopropyl)thiacyanine hydroxide triethylamine salt.

Emulsion 1B High Aspect Ratio Tabular Grain Low Iodide Emulsion

Emulsion 1B was a silver bromoiodide high aspect ratio tabular grain emulsion, 4.3 mole percent iodide, mean grain diameter 4.3 μm, mean grain thickness about 0.14 μm, average ratio about 30:1, tabular grain projected area >70 percent of total grain projected area. The emulsion was optimally sulfur and gold sensitized, and spectrally sensitized with Dye II, anhydro-5,5'-dichloro-3,3'-bis(3-sulfopropyl)thiacyanine hydroxide, triethylamine salt at 627 mg/Ag mole.

Example 1 Coatings

Emulsions 1A, 1B, and a 50:50 blend (Ag basis) were coated on an acetate support at 1.08 g/m$^2$ Ag and 2.69 g/m$^2$ gelatin. To the emulsion was added a dispersion of the yellow dye-forming Coupler I, α-[4-(4-hydroxyphenylsulfo)phenoxy]α-pivalyl-2-chloro-3-hexadecylsulfonamidoacetanilide, at 1.05 g/m$^2$. The coatings were hardened with bis(vinylsulfonylmethyl) ether at 1.75 percent of the total gelatin.

Samples of the coatings were exposed through a graduated density tablet (0-3) using a 3000° K. source for 0.01 sec, filtered with 1.0 neutral density+Wratten W2B filters. The samples were then processed in the Kodak C-41 Color Negative Process, with development for 3 min, 15 sec at 38° C.

The results are tabulated in Table I. The granularity differences are expressed in Grain Units (G.U.) where a GU is defined as about a 5 percent difference in contrast normalized RMS Granularity. For background on contrast normalized RMS Granularity attention is directed to H. E. Spencer, "Detective Quantum Efficiency and the Ratio of Gradient to Granularity in Silver Halide Films", *The Journal of Photographic Science*, Vol. 31, 1983, p. 119 et seq.

TABLE I

| Example 1 Coating Results | | | | | |
|---|---|---|---|---|---|
| Coating Number | Emulsion | Dmin | Relative Speed | Gamma | Δ Granularity G.U. |
| 1 | 1A | 0.26 | 100 | 1.24 | Control |
| 2 | 1B | 0.25 | 100 | 1.56 | −4 |
| 3 | 50:50 | 0.28 | 112 | 1.36 | −2 |

TABLE I-continued

| Coating Number | Example 1 Coating Results Emulsion | Dmin | Relative Speed | Gamma | Δ Granularity G.U. |
|---|---|---|---|---|---|
| | blend | | | | |

The data of Table I show that the low aspect ratio grain Emulsion 1A and the high aspect ratio tabular grain Emulsion 1B were of equal speed. As expected, the tabular grain emulsion was lower in granularity when coated at the same silver coverage as the low aspect ratio grain emulsion. The granularity of the 50:50 blend was intermediate, also as expected, but surprisingly, the speed of the blend was significantly higher than that of either emulsion when coated alone. An improved speed-granularity position thus resulted. Achieving a contrast (gamma) for the blended emulsion higher than that for the control emulsion 1A is also regarded as a significant advantage for many imaging applications.

Example 2 Emulsions of Slightly Differing Speeds

Emulsion 2A Low Aspect Ratio Grain Emulsion

Emulsion 2A was a silver bromoiodide low aspect ratio (<3:1) grain emulsion, 12 mole percent iodide of mean grain size 1.03 μm. It was optimally sulfur and gold sensitized and spectrally sensitized with Dye I at 194 mg/Ag mole.

Emulsion 2B High Aspect Ratio Tabular Grain Emulsion

Emulsion 2B was identical to Emulsion 1B.

Coating, exposure and processing as described for Example 1 provided the results tabulated in Table II.

TABLE II

| Coating Number | Example 2 Coating Results Emulsion | Dmin | Relative Speed | Gamma | Δ Granularity G.U. |
|---|---|---|---|---|---|
| 1 | 2A | 0.21 | 100 | 0.86 | Control |
| 2 | 2B | 0.25 | 85 | 1.56 | −10 |
| 3 | 50:50 Blend | 0.24 | 97 | 1.28 | −5 to −6 |

High aspect ratio tabular grain Emulsion 2B was significantly slower than the low aspect ratio grain Emulsion 2A and much lower in granularity when coated at the same silver level. The 50:50 blend was intermediate in granularity as expected, but surprisingly the speed was not significantly lower than that of the low aspect ratio grain emulsion. An improved speed-granularity position was thus provided by the blend. Obtaining a contrast (gamma) nearer that of the higher contrast emulsion 2B than the control emulsion 2A is also regarded as a significant advantage for many imaging applications.

Example 3 Range of Blend Ratios

Emulsion 3A Low Aspect Ratio Grain Emulsion

Emulsion 3A was identical to Emulsion 1A of Example 1.

Emulsion 3B High Aspect Ratio Tabular Grain Emulsion

Emulsion 3B was a silver bromoiodide high aspect ratio tabular grain emulsion, 3 mole percent iodide, mean grain diameter 3.7 μm, mean grain thickness about 0.135 μm, average aspect ratio about 27:1, and tabular grain projected area >70 percent. The emulsion was chemically and spectrally sensitized similarly to Emulsion 1B of Example 1.

The coatings were prepared, exposed and processed as described for Example 1, but using a range of blend ratios as tabulated in Table III.

TABLE III

| Coating Number | Example 3 Coating Results Emulsion Ratio* 3A | 3B | Dmin | Relative Speed | Gamma | Δ Granularity G.U. |
|---|---|---|---|---|---|---|
| 1 | 100 | 0 | 0.26 | 100 | 1.20 | Control |
| 2 | 75 | 25 | 0.24 | 100 | 1.33 | 0 |
| 3 | 50 | 50 | 0.21 | 95 | 1.51 | −3 |
| 4 | 25 | 75 | 0.18 | 89 | 1.55 | −3 |
| 5 | 0 | 100 | 0.16 | 82 | 1.59 | −5 |

*As percentage of total Ag coated.

The data of Table III indicate that the high aspect ratio tabular grain Emulsion 3B was signifcantly slower than the low aspect ratio grain Emulsion 3A. As the blend ratio of slower tabular grain emulsion increased to 50%, a scarcely significant speed loss was observed, while the granularity dropped by a significant 3 G.U. Further increases in the ratio of the tubular grain emulsion resulted in significant speed loss with the expected granularity decrease. Obtaining a contrast (gamma) for the blended emulsions much nearer the higher contrast of the higher contrast component emulsion 3B than the lower contrast of component emulsion 3A is also regarded as a significant advantage for many imaging applications.

Example 4 Range of Blend Ratios

Example 4A Low Aspect Ratio Grain Emulsion

Emulsion 4A was identical to Emulsion 2A of Example 2.

Example 4B High Aspect Ratio Tabular Grain Emulsion

Emulsion 4B was identical to Emulsion 3B of Example 3.

Coatings were prepared, exposed and processed using a range of blend ratios as in Example 3, with the results tabulated in Table IV:

TABLE IV

| Coating Number | Example 4 Coating Results Emulsion Ratio* 4A | 4B | Dmin | Relative Speed | Gamma | Δ Granularity G.U. |
|---|---|---|---|---|---|---|
| 1 | 100 | 0 | 0.15 | 100 | 0.51 | Control |
| 2 | 75 | 25 | 0.18 | 100 | 0.80 | −8 |
| 3 | 50 | 50 | 0.16 | 94 | 0.93 | −9.5 |
| 4 | 25 | 75 | 0.14 | 78 | 1.12 | −12.5 |
| 5 | 0 | 100 | 0.14 | 71 | 1.37 | −13.5 |

In this comparison there is a 29% difference in a relative speed between the two emulsions. In spite of this, only a slight speed loss was observed at the 50:50 blend. The same coating shows a 9.5 G.U. improvement over the low aspect ratio grain emulsion alone. The 25:75 blend exhibited a disproportionately large granularity reduction of 93% of that exhibited by the high aspect ratio tabular grain emulsion alone.

Comparative Example 5 Excessive Speed Difference

Example 5A Low Aspect Ratio Grain Emulsion

Example 5A was a silver bromoiodide low aspect ratio (<3:1) grain emulsion, 4.3 mole percent iodide. The emulsion was optimally sulfur and gold sensitized, and spectrally sensitized with 95 mg/Ag mole of Dye I.

Example 5B High Aspect Ratio Tabular Grain Emulsion

Emulsion 5B was identical to Emulsion 1B of Example 1.

Coatings were prepared, exposed and processed using a range of blend ratios as in Example 1, with the results tabulated in Table V:

TABLE V

Example 5 Coating Results

| Coating Number | Emulsion Ratio* 3A | 3B | Dmin | Relative Speed | Gamma | Δ Granularity G.U. |
|---|---|---|---|---|---|---|
| 1 | 100 | 0 | 0.13 | 191 | 0.24 | +20 |
| 2 | 50 | 50 | 0.18 | 110 | 1.10 | +5 |
| 3 | 0 | 100 | 0.14 | 100 | 1.37 | 0 |

In this comparison there is a 10% gain in relative speed produced by blending as compared with the speed of the low aspect ratio grain emulsion. However, a disproportionately large increase in granularity is incurred in achieving this speed increase. Therefore, the speed-granularity of the blended emulsion is inferior to that of either of the two component emulsions. This inferior result is attributed to the excessive difference in the speeds of the component emulsions.

The invention has been described in detail with particular reference to preferred embodiments thereof, but it will be understood that variations and modifications can be effected within the spirit and scope of the invention.

What is claimed is:

1. A blended emulsion comprised of 10 to 90 percent, based on total silver, of a high aspect ratio tabular grain emulsion containing at least one spectral sensitizing dye and 90 to 10 percent, based on total silver, of a low aspect ratio grain emulsion, said high and low aspect ratio grain emulsions being silver bromide or bromoiodide emulsions and said high and low aspect ratio grain emulsions exhibiting, prior to blending, relative speeds which differ by less than 50 percent, based on the higher speed emulsion, measured at the absorption peak of said spectral sensitizing dye.

2. A blended emulsion according to claim 1 further characterized in that the high and low aspect ratio grain emulsions exhibit, prior to blending, relative speeds that differ by less than 30 percent, based on the higher speed emulsion.

3. A blended emulsion according to claim 2 further characterized in that the high and low aspect ratio grain emulsions exhibit, prior to blending, relative speeds that differ by less than 10 percent, based on the higher speed emulsion, measured at the absorption peak of said spectral sensitizing dye.

4. A blended emulsion according to claim 1 further characterized in that the blended emulsion is comprised of from 25 to 75 percent, based on total silver, of the high aspect ratio tabular grain emulsion and from 75 to 25 percent, based on total silver, of the low aspect ratio grain emulsion.

5. A blended emulsion according to claim 4 further characterized in that the blended emulsion is comprised of at least 40 percent, based on total silver, of the high aspect ratio tabular grain emulsion.

6. A blended emulsion according to claim 1 further characterized in that the blended emulsion is a silver bromoiodide emulsion.

7. A blended emulsion according to claim 6 further characterized in that the high aspect ratio tabular grain emulsion contains a blue absorbing spectral sensitizing dye.

8. A blended emulsion according to claim 7 further characterized in that the low aspect ratio grain emulsion contains no spectral sensitizing dye prior to blending.

9. A blended emulsion according to claim 1 further characterized in that the high aspect ratio tabular grain emulsion is substantially optimally spectrally sensitized.

10. A blended emulsion comprised of 40 to 60 percent, based on total silver, of a high aspect ratio tabular grain silver bromoiodide emulsion containing at least one spectral sensitizing dye and 60 to 40 percent, based on total silver, of a low aspect ratio grain silver bromoiodide emulsion, and said high and low aspect ratio grain emulsions exhibiting, prior to blending, relative speeds which differ by less than 10 percent, based on the higher speed emulsion, measured at the absorption peak of said spectral sensitizing dye.

11. A blended emulsion according to claim 10 further characterized in that the spectral sensitizing dye has its peak absorption in the blue region of the visible spectrum.

12. A blended emulsion according to claim 1 further characterized in that each of said high and low aspect ratio grain emulsions are negative-working surface latent image forming emulsions.

* * * * *